United States Patent [19]

Wyse

[11] Patent Number: 4,759,162

[45] Date of Patent: Jul. 26, 1988

[54] MODULAR PLATFORM ASSEMBLY

[76] Inventor: Steven J. Wyse, 595 E. Lugbill Rd., Archbold, Ohio 43502

[21] Appl. No.: 38,927

[22] Filed: Apr. 16, 1987

[51] Int. Cl.[4] ..... E04B 5/58

[52] U.S. Cl. ..... 52/126.6; 52/594; 52/183

[58] Field of Search ..... 52/126.6, 126.7, 79.6, 52/126.4, 591, 594, 7, 182, 183, 184, 191; 248/188.5, 188.8, 188.9, 677; 182/179, 222

[56] References Cited

U.S. PATENT DOCUMENTS

| | | | |
|---|---|---|---|
| 3,500,606 | 3/1970 | Wharmby | 52/594 X |
| 3,565,501 | 2/1971 | Brown et al. | 248/188.5 |
| 3,808,757 | 5/1974 | Greenwood | 52/79.6 X |
| 3,811,237 | 5/1974 | Bettinger | 52/126.6 |
| 3,924,370 | 12/1975 | Cauceglia et al. | 52/126.6 |
| 4,104,835 | 8/1978 | Bardwick, III | 52/7 |
| 4,277,923 | 7/1981 | Rebentisch et al. | 52/126.6 |
| 4,406,347 | 9/1983 | Stathopoulos | 52/183 X |
| 4,468,901 | 9/1984 | Henderson et al. | 52/79.6 |
| 4,546,581 | 10/1985 | Gustafson | 52/126.6 X |
| 4,598,510 | 7/1986 | Wagner, III | 52/126.6 |
| 4,638,604 | 1/1987 | Rogers et al. | 52/126.6 X |

*Primary Examiner*—Carl D. Friedman
*Assistant Examiner*—Creighton Smith
*Attorney, Agent, or Firm*—Allen D. Gutchess, Jr.

[57] ABSTRACT

A modular platform assembly is provided. The assembly has a multiplicity of deck sections of rectangular shape which are connected together or interlocked to produce a platform of desired size. The deck sections are supported on legs which can be used in telescoping relationship to support the deck sections at various desired heights. Certain inner deck sections need only be supported on one leg, which facilitates assembly of the sections. Guard rails can also be employed around edges of the platform and supported by the legs. The legs can be supported on adjustable feet to provide a uniform level for the deck sections. Modular stairs are also provided for easy access to and egress from the platform. The stairs are designed to accommodate platforms of various heights.

13 Claims, 3 Drawing Sheets

MODULAR PLATFORM ASSEMBLY

This invention relates to a modular platform assembly and particularly one which can be assembled and dismantled relatively easily.

There is a substantial need for modular platform assemblies which can be relatively quickly assembled and dismantled for temporary use but which also have strength and durability for longer term use. While such platform assemblies have been known in the past to a limited extent, the components of the assemblies have tended to be cumbersome and require considerable labor to assemble and to later disassemble or dismantle.

The modular platform assembly in accordance with the invention includes rectangular, preferably square, deck sections which can be employed in virtually any numbers to provide platforms or stages of any desired area. Each of the deck sections has a rectangular metal frame to which is affixed wooden sheeting or the like. Contiguous sides of the frame have interlocking means by which adjacent sections can be readily connected, with the sheeting forming a smooth. unbroken surface. The corners of each deck section frame have downwardly-extending connecting tubes which receive upper ends of supporting legs. The supporting legs can be of various lengths according to the height desired for the overall platform. Further, the supporting legs can be employed with other legs of different cross-sectional sizes in telescoping relationship to provide even greater heights. Connecting pins can also be inserted through holes in the connecting tubes of adjacent sections to provide greater rigidity and support for the sections.

Specially designed guard rail posts can also be mounted around the periphery of the platform and affixed to the platform supporting legs. The posts have threaded studs to which guard rails can be readily connected and disconnected.

The supporting legs can also be provided with adjustable feet to assure a level and planar horizontal supporting surface formed by the wooden sheeting.

The modular platform assembly also has stairs with telescoping diagonal legs and detachable steps which enable the stairs to be used with platforms of various heights.

It is, therefore, a principal object of the invention to provide a modular platform assembly which can be relatively easily assembled and dismantled.

Another object of the invention is to provide a modular platform assembly which can be relatively quickly assembled for temporary use and which is also sufficiently strong and durable for long-term use.

Yet another object of the invention is to provide a modular platform assembly having the features discussed above.

Many other objects and advantages of the invention will be apparent from the following detailed description of preferred embodiments thereof, reference being made to the accompanying drawings, in which.

Figure 1:
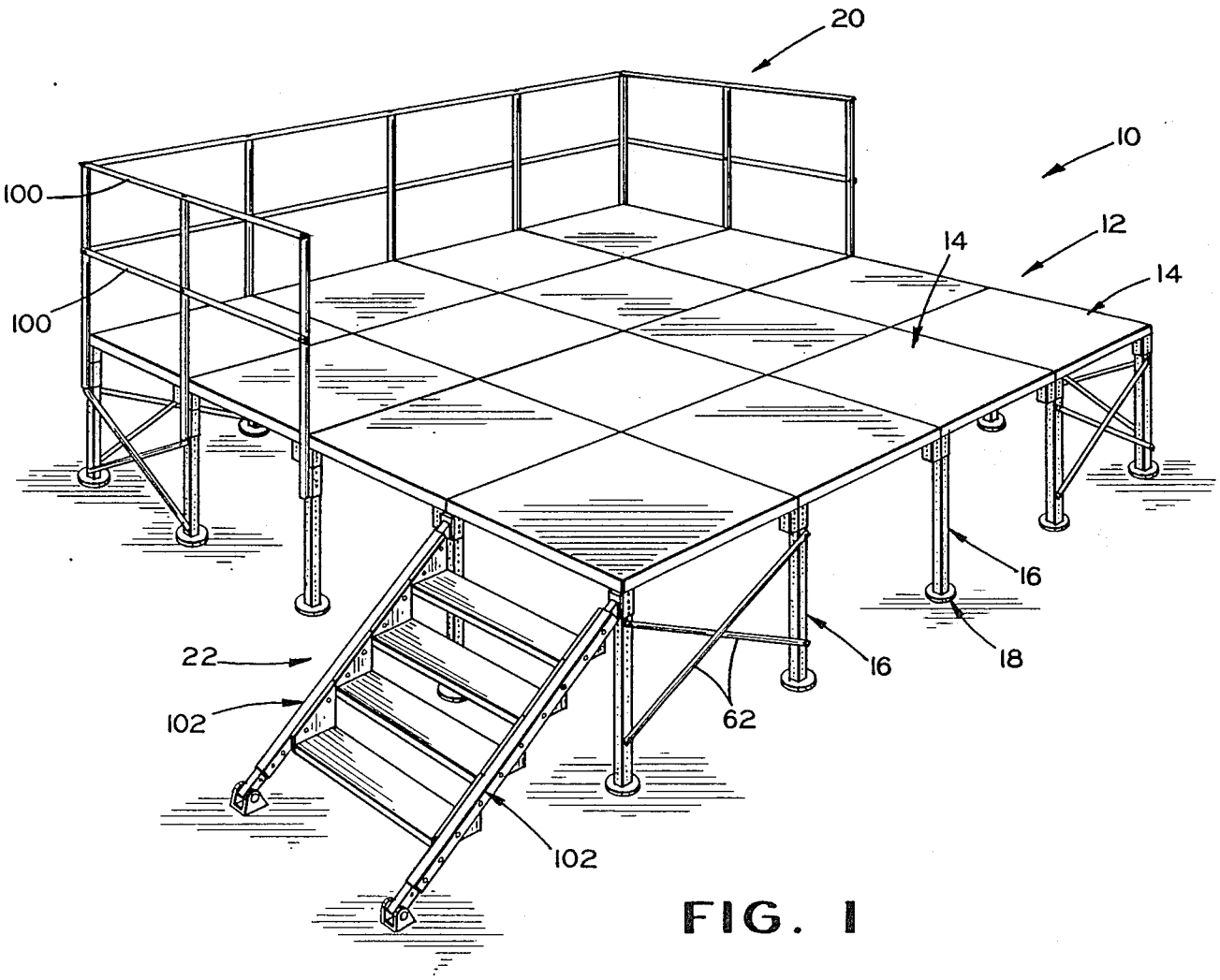
FIG. 1 is a somewhat schematic view in perspective of an overall modular platform assembly in accordance with the invention.

Referring to the drawings and particularly to FIG. 1 a modular platform assembly in accordance with the invention is indicated at 10 and includes a modular platform or stage 12 which can be of a variety of areas and heights. The platform is made up of deck sections 14 which preferably are all of the same size and shape. The shape is preferably square and the size is preferably four feet by four feet, which enables the sections to be relatively easily handled, transported, and stored. The deck sections 14 can be positioned at various heights to meet the particular needs, the deck sections being supported on supporting legs 16. The legs 16 have adjustable supporting feet 18 which assure that the deck sections lie in smooth, planar relationship.

The platform assembly 10 also can have a guard rail assembly 20 around at least portions of the perimeter thereof for safety purposes. The modular platform assembly also includes stairs 22 which are designed to accommodate the platforms 12 of various heights.

Figure 2:
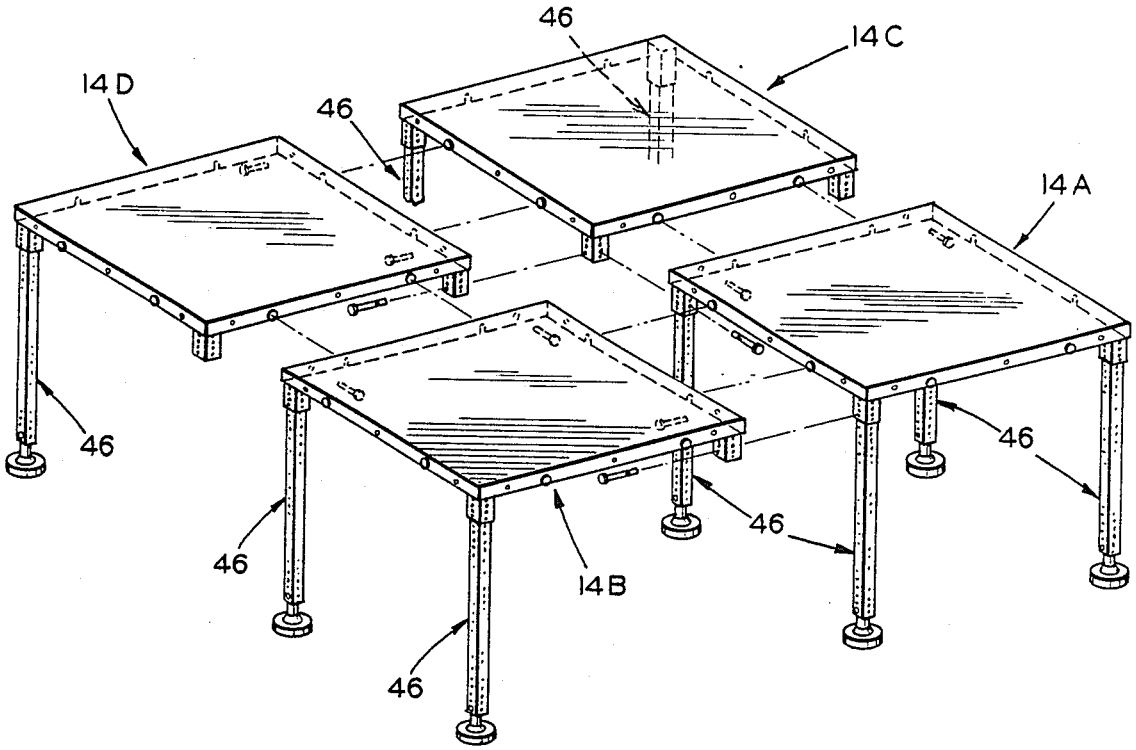
FIG. 2 is an exploded view in perspective of several platform sections and supporting legs about to be assembled.
Figure 3:
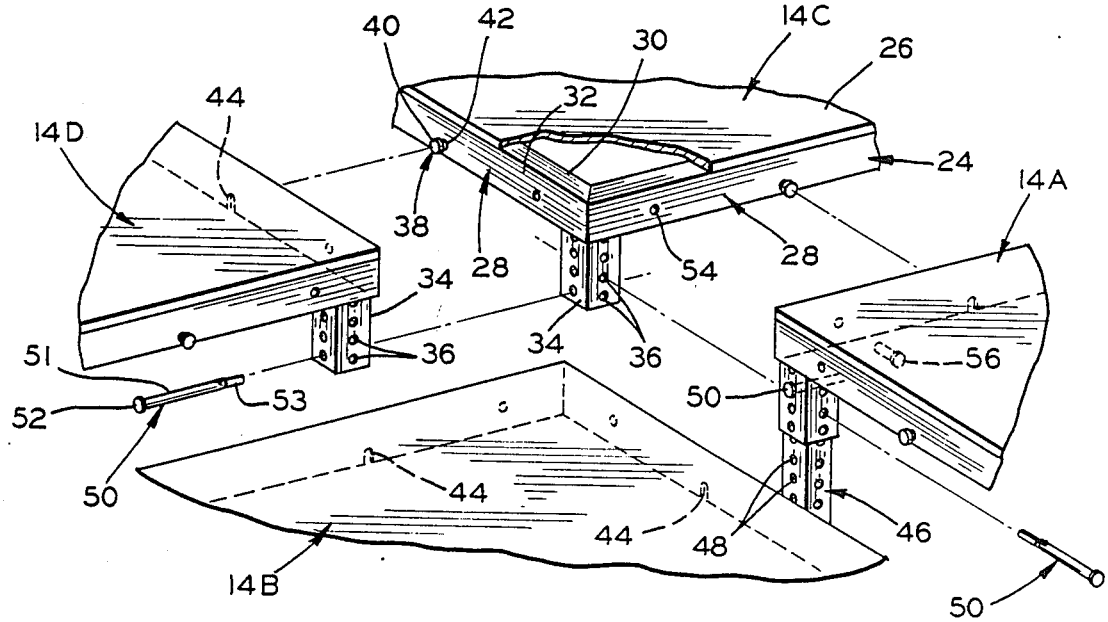
FIG. 3 is an enlarged, fragmentary, exploded view in perspective of the deck sections and some of the supporting legs of FIG. 2, in the same relationship.
Figure 4:
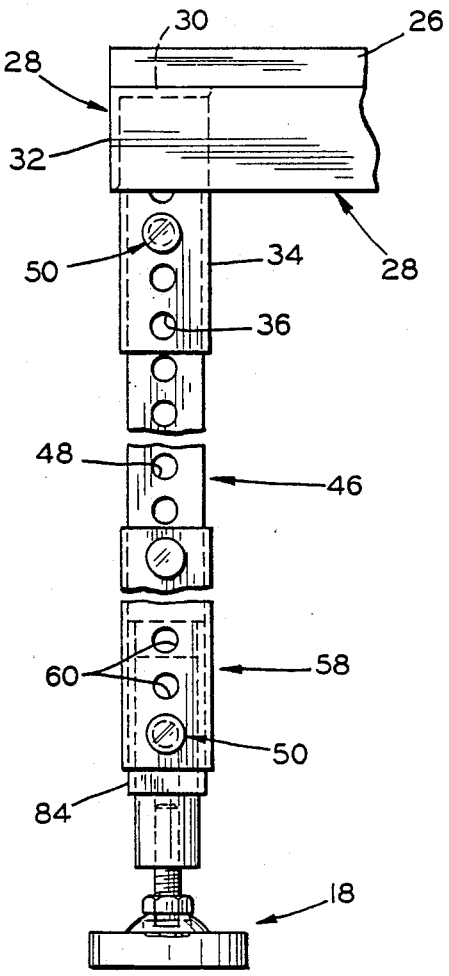
FIG. 4 is a further enlarged, fragmentary view in elevation of a deck section, a modified supporting leg, and an adjustable foot.

Referring to FIGS. 2–4, each of the deck sections 14 includes a rectangular metal frame 24 and a rectangular wooden sheeting 26 of the same size and shape. The sheeting 26 can be one-half or three-quarter inch exterior plywood, for example. The metal frame 24 is made of angle-iron members 28, each of which includes an inwardly-extending horizontal flange 30 and a downwardly-extending vertical flange 32. Each of the corners of the rectangular frame 24 has a short, downwardly-extending, connecting member or tube 34 affixed thereto at the juncture of the angle-iron members 28. This can be accomplished by welding, for example. In a preferred form, each of the connecting tubes 34 is of square shape in transverse cross section and has a plurality of openings 36 uniformly spaced, preferably at one inch intervals, along the length thereof and on each face thereof.

The deck sections 14 have interlocking or connecting means so that contiguous sections can be placed in interlocking relationship. For this purpose, as shown, each of two connected angle-iron members 24 has pins 38 (FIG. 3) affixed to the vertical flanges 32 at predetermined positions therealong. Each of the pins 38 has a head 40 and a stem 42 affixed to the vertical flange 32 and spacing the head 40 therefrom. Similarly, the other two adjacent ones of the angle-iron frame members 28 have notches 44 spaced along the vertical flanges 32 at predetermined positions, with open ends facing downwardly at the lower edges of the flanges 32. With this arrangement, two of the contiguous sections 14 are interlocked by placing the notches 44 over the heads 40 of the pins 38 so as to be received on the stems 42 of the pins. This helps maintain the upper surfaces of the sheeting 26 in coplanar, unbroken relationship to provide an overall smooth surface.

The deck sections 14 are supported at a predetermined height by supporting legs 46. Like the connecting tubes 34, the legs 46 are of square shape in transverse cross section and have holes 48 uniformly spaced, preferably at one inch intervals, therealong. The supporting legs 46 can be supplied in a variety of lengths, such as two feet, three feet, and four feet, to provide desired platform heights. The maximum dimension across parallel faces of the legs 46 is preferably slightly less than the minimum, inner dimension across parallel faces of the connecting tubes 34. This enables the legs 46 to telescope into the connecting tubes 34 with a relatively snug fit. When the legs 46 are in place, connecting hinge pins 50 are inserted through the aligned holes 36 and 48 in the connecting tubes 34 and the supporting legs 46 to assemble the legs 46 with the deck sections 14. The connecting hinge pins 50 are well known in the scaffolding art. They include shanks 51, heads 52, and hinged outer ends 53 which can swing down when the pins 50 are in place to prevent accidental loosening and separation on the pins 50 from their connected elements. For some heavy duty applications, the angle-iron flanges 32 can have bolt holes 54 to fasten the adjacent sections 14 together by bolts 56, if desired.

When the deck sections 14 are to be assembled into the platform 12 of the desired size (in four foot increments), an outer corner one of the deck sections 14, designated 14A in FIGS. 2 and 3 is first assembled with four of the supporting legs 46. Contiguous ones of the deck sections 14, designated 14B and 14C in FIGS. 2 and 3, are then provided with two of the supporting legs 46 at the outer edges thereof, away from the section 14A. The sections 14B and 14C are then interlocked with the section 14A by connecting pins 38 with the notches 44. Only one of the supporting legs 46 is then connected with an inner section 14D which is then interlocked with the sections 14B and 14C through the pins and notches. From this, it will be seen that assembly of the sections is relatively easy since the outer peripheral sections 14B and 14C require only two assembled legs and the inner sections such as the section 14D require but one of these supporting legs 46.

As the deck sections 14A–D are assembled, the pins 50, or longer versions thereof are connected through certain ones of the holes 36 in the connecting tubes 34 to assure that all of the connecting tubes not having legs are supported through one of the connecting tubes 34 that does have the leg 46 therein. Thus, at least three pairs of the holes 36 are provided in the connecting tubes 34 to receive the supporting leg pins and the connecting pins of the four adjacent, connected deck sections 14.

For greater heights of the platform 12, supporting extension legs 58 of FIG. 4 can be employed. The legs 58 are also square in transverse cross section and have holes 60 in faces thereof spaced uniformly therealong, preferably at one inch intervals. The legs 58 are preferably of the same size as the connecting tubes 34 so that they can telescope over the lower ends of the supporting legs 46 to provide higher positions for the platform 12. The extension legs 58 can also be provided in suitable lengths, such as two feet, three feet, and four feet.

Particularly when the extension legs 58 are used with the supporting legs 46, cross bars 62 are used between at least certain ones of the corner legs, as is well known in the scaffolding art, and are shown in FIG. 1.

Figure 5:
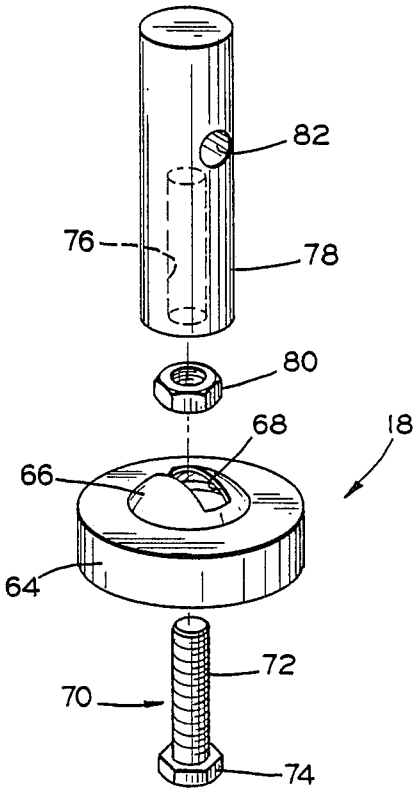
FIG. 5 is a further enlarged, exploded view in perspective of the adjustable foot of FIG. 4.

The adjustable foot 18 enables the surface of the platform to be truly level. Referring to FIGS. 4 and 5, the foot 18 includes a rubber, doughnut-shaped pad 64 into which is molded a flange of a dome-shaped plate 66 having an arcuate slot 68 therein. An adjusting bolt 70 has a threaded shank 72 extending upwardly through the slot 68 with a head 74 below the slot. The threaded shank 72 is received in a threaded bore 76 of a connecting cylindrical member 78 with a jam nut 80 located between the lower end of the member 78 and the plate 66. The cylindrical member 78 has a cross hole 82 at a predetermined position therein which receives the hinge pin 50 or similar pin when the member 78 is inserted into the lower end of the leg 48 or the leg 58. When the bolt shank 72 is turned into the bore 76 to achieve the desired position, the jam nut 80 is turned down against the top surface of the dome-shaped plate 66 to hold the bolt 70 in position.

When the extension leg 58 is used, a short sleeve 84 (FIG. 4) is used inside the lower connecting leg 58 to fit snugly with the connecting member 78. The sleeve 84 is of the same transverse shape and size as the connecting tube 34.

Figure 6:
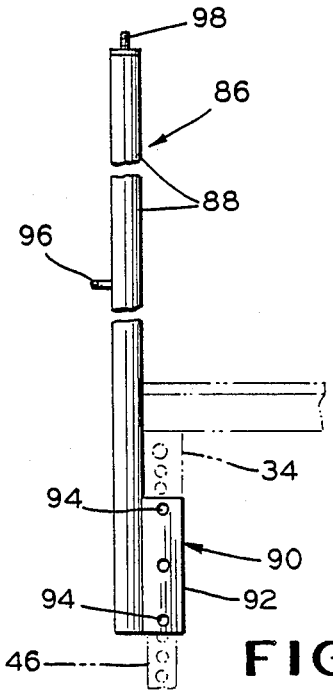
FIG. 6 is a somewhat schematic view in elevation of a guard rail post and supporting elements of the assembly.

The guard rail of FIG. 1 includes a plurality of guard rail posts 86, as shown in FIG. 6. The post 86 includes a metal tube 88 to which an angle-iron connection 90 is affixed at the lower end. The connection 90 has an outwardly-extending flange 92 with three holes 94 therein by means of which the post 86 can be affixed to an upper portion of one of the supporting legs 46 below the connecting tube 34 by the pins 50 or other suitable fasteners. A horizontal, threaded stud 96 is affixed to an intermediate portion of the tube 88 and a vertical, threaded stud 98 is affixed to an upper end of the tube 88. Horizontal guard rails 100 (FIG. 1) are fastened to the studs 96 and 98 by wing nuts (not shown) or other fasteners.

Figure 7:
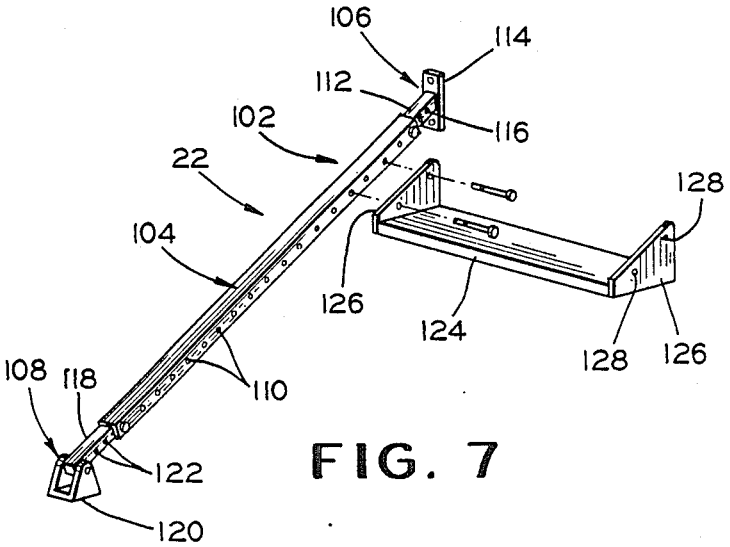
FIG. 7 is an exploded view in perspective of part of the stairs used to provide easier access to and egress from a platform of various heights.

The stairs 22 of FIG. 1 must be able to accommodate varying heights of the platform 12. Referring also to FIG. 7, the stairs 22 includes two diagonal supporting rails 102, each of which includes a diagonal main tube 104 with end extension assemblies 106 and 108. The tube 104 is square in transverse cross section and includes uniformly-spaced holes 110 along at least two opposite faces thereof. The upper extension 106 includes an extension tube 112 telescoped in the upper end of the tube 104 with a diagonal connecting plate 114 affixed to the outer end thereof. The plates 114 can be bolted or pinned to the connecting tubes 34 or the supporting legs 46 of one of the deck sections 14. The extension tube 112 has holes 116 therein which receive the pins 50 or similar suitable pins which are extended through the holes 110 of the tube 104.

The foot extension 108 similarly has an extension tube 118 with a pivoted foot 120 at the end thereof to support the lower end of the stairs on the ground. The extension 118 also has holes 122 through which the pins 50 or similar pins are received when extended through the holes 110 in the diagonal tube 104. The extension tubes 112 and 118 can be of substantial length to accommodate platform heights of substantial variations.

Steps 124 are provided between the rails 102, the steps having generally triangular end plates 126 affixed thereto and extending upwardly therefrom. These have holes 128 through which the pins 50 or similar pins are inserted and extend through the aligned holes 110 of the tubes 104 to support the steps in a horizontal manner. These steps will always be substantially horizontal since the supporting rails 102 are always substantially at the same angle relative to the platform 12.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. A modular platform assembly comprising a plurality of deck sections, each having a rectangular frame made of metal frame members joined at their ends, each of said deck sections having downwardly-extending connecting tubes at the joined ends of said frame members, two of said joined frame members each having fastener means extending outwardly therefrom, each of the other two joined frame members having fastener-receiving means positioned to receive fastener means of other frame members, said deck sections including peripheral deck sections forming peripheral portions of the platform and inner deck sections forming inner portions of the platform, each of said peripheral deck sections having at least two supporting legs connected with two of the connecting tubes thereof, each of said inner deck sections having only one supporting leg connected with one of the connecting tubes thereof, an adjustable foot for each of said supporting legs, stairs comprising two diagonal tubular rails each having connecting means at one end for making a connection with one of said connecting tubes and said supporting legs of said peripheral deck sections, the other ends of said rails having adjusting tubes adjustably connected therewith, for supporting the corresponding ends of said rails on the ground, a plurality of steps, step plates affixed to ends of said steps and extending upwardly, and means connecting said step plates at predetermined positions along said diagonal rails, and a plurality of guard rail posts, said guard rail posts having means at lower ends thereof for connecting said posts to some of said supporting legs, and guard rails affixed to upper portions of said guard rail posts.

2. A platform assembly according to claim 1 characterized by each of said connecting tubes being of predetermined length and having pairs of mutually perpendicular holes spaced at uniform distances therealong, and pin means extending through holes of the adjacent connecting tubes of the connected deck sections.

3. A platform assembly according to claim 1 characterized by each of said fastener means comprising a shank and a head spaced from the frame member and each of said fastener-receiving means comprising a notch in the other two joined frame members received over the shank of one of said fastener means.

4. A platform assembly according to claim 1 characterized by each of said guard rail posts having studs at upper ends thereof for receiving guard rails and having outwardly-extending studs at intermediate portions thereof for receiving other guard rails.

5. A platform assembly according to claim 1 characterized by each of said connecting means of said diagonal tubular rails being adjustably connected to the ends of said rails for longitudinal movement with respect thereto.

6. A modular platform assembly comprising a plurality of deck sections, each having a rectangular frame of metal members of predetermined lengths joined at their ends, each of said members having a downwardly-extending flange, each of said deck sections having downwardly-extending short connecting tubes at the joined ends of said members, said short tubes being of predetermined length and having pairs of mutually perpendicular holes spaced at uniform distances therealong, the flanges of two joined members each having fasteners extending outwardly therefrom, the flanges of the other two joined members each having openings therein to receive the fasteners of a frame member of another deck section, a first one of said deck sections having four tubular legs connected with the four short tubes of said first deck section, a second one of said deck sections having one of the frame members connected with one of the frame members of said first deck section, said second deck section having two of said tubular legs connected to the two short tubes spaced from said first deck section, a third one of said deck sections having one of the frame members connected to the frame member of said first deck section which is joined to the connected frame member of said first deck section, said third deck section having tubular legs connected to the short tubes which are spaced from said connected frame member of said third deck section, and a fourth deck section having two of the joined frame members connected to frame members of said second and third deck sections which are joined to their connected frame members, said fourth deck section having one tubular leg connected to the short tube which is away from both of the joined frame members of said fourth deck section.

7. A platforms assembly according to claim 6 characterized by each of said fasteners of said flanges having a shank and a head at an end of said shank spaced from the flange and the openings of said flanges being notches in the lower edges thereof to receive the shanks of the fastners.

8. A platform assembly according to claim 6 characterized by each of said metal frame members also having an inwardly-extending flange and each of said deck sections having planar sheeting affixed to the inwardly-extending flanges.

9. A modular platform assembly comprising a deck section having a rectangular frame made of angle-iron members of predetermined lengths joined at their ends, each of said members having an inwardly-extending horizontal flange and a downwardly-extending vertical flange at an outer longitudinal edge of the inwardly-extending flange, said deck section having downwardly-extending short tubes at the joined ends of said angle-iron members, said short tubes being of predetermined length and having at least two pair of mutually perpendicular holes spaced at uniform distances therealong, the downwardly-extending flanges of two joined angle-iron members each having at least one headed fastener having a head and a shank with the shank affixed to the downwardly-extending flange and extending perpendicularly therefrom at a predetermined location, with the head of the fastener being spaced from the downwardly-extending flange, the downwardly-extending flanges of the other two angle-iron members each having at least one notch in a lower longitudinal edge thereof at a predetermined location to receive the shank of a fastener of an angle-iron member of another deck section, a tubular leg telescoped with one of said short tubes, said tubular leg having pairs of mutually perpendicular holes spaced at uniform distances along substantially the entire length of said leg, a pin extending through one pair of the holes of the associated short tube and one pair of the holes of the leg, a second tubular leg telescoped within another one of said short tubes, said second leg having pairs of mutually perpendicular holes spaced at uniform distances along substantially the entire length of said second leg, a pin extending through one pair of holes of the associated short tube and one pair of holes of said second leg, stair means comprising two connecting tubes having diagonally disposed end plates at ends thereof and having at least one pair of holes therein, means affixing said end plates to holes in one of said connecting tubes and said tubular legs, two diagonal tubular rails telescoped over said connecting tubes, said diagonal rails having a plurality of pairs of holes spaced at uniform distances along substantially the entire lengths thereof. two extension tubes telescoped within said diagonal rails at ends opposite the ends telescoped with said connecting tubes, said extension tubes having at least one pair of holes therein, pin means connecting said connecting tubes and said diagonal rails, pin means connecting said extension tubes and said diagonal rails, a foot pivotally connected to each of said extension tubes, a step, step plates affixed to ends of said steps, said step plates having at least two holes therein, and fastener means connecting said step plates to holes in intermediate portions of said diagonal rails.

10. A modular platform assembly according to claim 9 characterized by a vertical guard rail post, a lower end of said post having an outwardly-extending vertical plate affixed thereto, fastener means detachably connecting said plate to said tubular leg, and guard rail fastener means affixed to and projecting from at least one upper portion of said guard rail post.

11. A modular platform assembly comprising a deck section having a rectangular frame made of frame members of predetermined lengths joined at their ends, each of said members having an inwardly-extending horizontal flange and a downwardly-extending vertical flange at an outer longitudinal edge of the inwardly-extending flange, said deck section having downwardly-extending short tubes at the joined ends of said frame members, said short tubes being of predetermined length and having a first two pair of mutually perpendicular holes at a predetermined location therein, and a second two pair of mutually perpendicular holes spaced at a predetermined distance from said first two pair, the downwardly-extending flanges of two joined frame members having fasteners, the downwardly-extending flanges of the other two frame members having notches in lower longitudinal edges thereof at predetermined locations to receive fasteners of frame members of other deck sections, a tubular leg telescoped with one of said short tubes, said tubular leg having a third two pair of mutually perpendicular holes at a predetermined location therein and a fourth two pair of mutually perpendicular holes spaced from the third two pair a distance equal to the distance between the first and second two pair of holes, a pin extending through one pair of the holes of the leg and one pair of the holes of the associated short tube, and two aligned holes of the other two pair of mutually-perpendicular holes in the short tubes being aligned with two aligned holes of two pair of mutually-perpendicular holes of a short tube of another deck section, whereby fasteners can be extended through these holes to enable one of the tubes of said deck section to be connected with one of the tubes of the other deck section.

12. A modular platform assembly according to claim 11 characterized by said short tubes being square in transverse cross section.

13. A modular platform assembly comprising a deck section having a rectangular frame made of angle-iron members of predetermined lengths joined at their ends, each of said members having an inwardly-extending horizontal flange and a downwardly-extending vertical flange at an outer longitudinal edge of the inwardly-extending flange, said deck section having downwardly-extending short tubes at the joined ends of said angle-iron members, said short tubes being of predetermined length and having at least two pair of mutually perpendicular holes at a predetermined location therein, the downwardly-extending flanges of two joined angle-iron members each having at least two headed fasteners, each fastener having a head and a shank with the shank affixed to the downwardly-extending flange and extending perpendicularly therefrom at a predetermined location, with the head of the fastener being spaced from the downwardly-extending flange, the downwardly-extending flanges of the other two angle-iron members each having at least two notches in a lower longitudinal edge thereof at predetermined locations to receive the shanks of fasteners of an angle-iron member of another deck section said other two angle-iron members being devoid of headed fasteners or any other projections, one frame member of each opposite pair having only said notches and the other frame member of each opposite pair having said fasteners.

* * * * *

UNITED STATES PATENT AND TRADEMARK OFFICE

CERTIFICATE OF CORRECTION

PATENT NO. : 4,759,162

DATED : July 26, 1988

INVENTOR(S) : Steven J. Wyse

It is certified that error appears in the above-identified patent and that said Letters Patent is hereby corrected as shown below:

Column 6, claim 7, line 25, "platforms" should be --platform--

Column 7, claim 9, line 9, "thereof." should be --thereof,--.

Column 8, claim 13, line 41, "section" should be --section,--.

Signed and Sealed this

Twentieth Day of December, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,759,162

DATED : July 26, 1988

INVENTOR(S) : Steven J. Wyse

It is certified that error appears in the above-identified patent and that said Letters Patent is hereby corrected as shown below:

In the claims:

Claim 1, line 15, "each" should be --at least some--.

Signed and Sealed this

First Day of August, 1989

*Attest:*

*Attesting Officer*

DONALD J. QUIGG

*Commissioner of Patents and Trademarks*